US006779270B2

(12) United States Patent
Sonti et al.

(10) Patent No.: US 6,779,270 B2
(45) Date of Patent: Aug. 24, 2004

(54) FULL FORM ROLL FINISHING TECHNIQUE

(75) Inventors: Nagesh Sonti, State College, PA (US); Suren B. Rao, State College, PA (US); James V. Caldwell, Warren, MI (US)

(73) Assignee: The Penn States Research Foundation, University Park, PA (US)

( * ) Notice: Subject to any disclaimer, the term of this patent is extended or adjusted under 35 U.S.C. 154(b) by 273 days.

(21) Appl. No.: 10/056,928

(22) Filed: Jan. 24, 2002

(65) Prior Publication Data

US 2002/0066183 A1 Jun. 6, 2002

Related U.S. Application Data

(63) Continuation-in-part of application No. 09/351,400, filed on Jul. 13, 1999.

(51) Int. Cl.[7] ..... B21D 53/28; B21K 1/30; B23P 15/14

(52) U.S. Cl. ..... 29/893.32; 29/893.3; 29/893.34; 72/108

(58) Field of Search ..... 29/893.3, 893.34, 29/893.35, 893.32, DIG. 32; 72/108

(56) References Cited

U.S. PATENT DOCUMENTS 3,362,059 A 1/1968 DiPonio et al. ..... 29/159.2
3,631,703 A * 1/1972 Bregi et al. ..... 72/108
3,659,335 A 5/1972 Bregi et al. ..... 29/560
3,777,345 A * 12/1973 Brown ..... 72/102
3,795,958 A * 3/1974 Psenka ..... 407/19
3,846,999 A 11/1974 Connell ..... 72/68
4,373,973 A 2/1983 Cellitti et al. ..... 148/12.4
4,744,836 A 5/1988 Pfaffmann ..... 148/12 R
5,221,513 A 6/1993 Amateau et al. ..... 266/81
5,230,234 A * 7/1993 Fuhrman ..... 72/70
5,451,275 A 9/1995 Amateau et al. ..... 148/573
5,528,917 A * 6/1996 Bajraszewski et al. ..... 72/10.6
5,655,987 A * 8/1997 Bowerman et al. ..... 475/248
5,711,187 A 1/1998 Cole et al. ..... 74/434
5,918,495 A * 7/1999 Miyamoto et al. ..... 72/108
6,007,762 A * 12/1999 Amateau et al. ..... 266/118

* cited by examiner

*Primary Examiner*—Essama Omgba
(74) *Attorney, Agent, or Firm*—Perman & Green, LLP

(57) ABSTRACT

A full form net shape roll finished contacting machine element such as a gear or sprocket is produced from a near net shape workpiece of wrought or forged steel including teeth with an initial outer peripheral contoured surface, each having a tooth flank with a nominally involute surface and a root/fillet region with a trochoidal surface. A rolling die is rotatably supported on a first axis. With the workpiece rotatably supported on a parallel distant second axis, the rolling die is advanced in an in-feed direction to meshingly engage with the workpiece. The involute surface of each tooth of the rolling die engages the involute surface of a mating tooth of the workpiece and the tooth tip of the rolling die engaging the trochoidal root/fillet surface between adjacent mating teeth of the workpiece to effect material flow along the outer peripheral contoured surface. This process continues for all of the teeth of the workpiece.

10 Claims, 8 Drawing Sheets

FULL FORM ROLL FINISHING TECHNIQUE

This application is a continuation-in-part of prior application No. 09/351,400 filed Jul. 13, 1999.

GOVERNMENT SPONSORSHIP

This invention was made with Government support under Contract No. N00039-92-C-0100 awarded by U.S. Department of the Navy. The Government has certain rights in the invention.

BACKGROUND OF THE INVENTION

1. Field of the Invention

The present invention relates to a technique for precision form finishing of the entire contour of a machine element, typically the teeth of a spur or helical gear or of a sprocket, made of wrought or forged alloyed carbon steels, including the active contacting surfaces and the trochoidal root/fillet regions, thereby inducing material flow in the critical regions of the teeth. Full form finishing by plastically deforming these regions results in improved surface finish, higher strength and accuracy of the teeth of the machine element. Throughout the ensuing disclosure, the mention, for example, of gears or of helical gears is not to be taken in a limiting manner but only for purposes of description.

2. Description of the Prior Art

Highly loaded transmission gears used for automotive and aerospace applications are normally manufactured using wrought or forged low carbon low-to-medium alloyed steels, by blank machining to produce the gear teeth, followed by carburizing and hardening heat treatments to impart high surface strength and hardness combined with adequate toughness of the core. Alternate to above carburizing grade low carbon alloyed steels are medium-to-high carbon and alloyed through-hardening type steels, which do not require the carburizing cycle. Alternate methods for producing the gear teeth include near net forging. Aerospace gears, and some automotive gears, are then hard finished by grinding after heat treatment to impart the required dimensional accuracy and surface finish. However, cost considerations preclude expensive hard finishing operations for most automotive gears, and instead, pre-finishing techniques such as gear roll finishing and shaving are often used prior to heat treatment. Gear shaving is a free-cutting material removal process that improves the gear tooth accuracy and surface finish by machining a thin layer of stock (0.001" 0.003" per tooth flank) from the tooth surfaces. On the other hand, gear roll finishing is a form-finishing process that improves accuracy and surface finish by plastically deforming and moving a thin layer of stock (0.001"–0.002" per tooth flank) across the gear tooth surfaces. Roll finishing produces much finer surface finish of 4–6 $\mu$in Ra as compared to 25 $\mu$in Ra achieved by shaving. Both gear shaving and conventional gear rolling processes finish only the active contacting tooth surfaces, and do not touch the trochoidal root and fillet regions of the gear teeth. Therefore, for rolling or shaving operations, the gears are produced with rolling or shaving stock only on the tooth flanks, and not on the root/fillet regions. The rolling dies used for conventional roll finishing are designed with tip clearance to avoid contacting the fillet and root regions of the gear teeth.

If the roll finishing operation were extended to finish the root/fillet regions in addition to the active contacting surfaces of the gear teeth made of wrought or forged alloyed carbon steels, then the surface finish and bending fatigue strength of the gear teeth would be substantially improved.

Root fillet regions of gear teeth experience the maximum bending stress. Roll finishing of the root/fillet regions will improve the surface finish, thereby reducing the stress concentration, and enhance the fatigue resistance of the material due to plastic deformation and flow of the rolling stock.

Therefore, to produce wrought or forged steels gears with improved accuracy, surface finish and enhanced load carrying capacity, the gear roll finishing process must be applied to both the active contacting surfaces as well as the trochoidal root fillet regions of the helical gear teeth.

A number of patents are definitive of the prior art in this regard. For example, U.S. Pat. No. 3,659,335 to Bregi et al. discloses a combined gear shaving and rolling machine. Provision is made for relative traverse while shaving in a direction parallel to the axes of the gear and tool and for incremental in-feed during shaving and continuous in-feed during gear rolling.

The process of roll finishing of gears is covered by U.S. Pat. No. 3,362,059 to DiPonio et al.

U.S. Pat. No. 5,221,513 to Amateau et al. discloses a system for the thermomechanical processing of gears in which precise control of the thermal conditions, the environment and mechanical actions during the forming process is maintained. The essence of the patent resides in the process control methods and architecture for accomplishing precision motions, thermal control, and environmental control using a unique combination of sensors, mechanisms, and software. The apparatus includes an induction heating system which reaustenitizes the surface of the gear with minimum decarburization, a material transfer system which provides timely operations on the work piece, tooling and fixture adjustments which provide accurate initial conditions for forming, and a process control architecture that provides the precise sequence and timing necessary to achieve metallurgically sound and dimensionally accurate gears. Both through-feed and in-feed motion are simultaneously controlled by load, position, and velocity transducers which provide feedback information to a supervising microprocessor.

U.S. Pat. No. 5,451,275 also to Amateau et al. is an improvement on the '513 patent and provides an apparatus for precision gear finishing by controlled deformation using a fixed axis through-feed and coordinated and controlled moving axes in-feed of two rolling dies positioned on diametrically opposing sides of the workpiece. As with its predecessor technique, this later patented invention also includes apparatus for achieving controlled deformation, apparatus for providing precise adjustment of the axes of the two rolling dies from a remote location while the rolling apparatus is thermally stabilized and maintained at the forming temperature and under an inert atmosphere, and apparatus for performing a timely transfer of the workpiece to achieve the optimum metallurgical condition at each stage of the thermomechanical gear finishing process. The essence of this later invention is the concept of using two rolling dies, and process control methods and architecture for accomplishing precision motions, thermal control, and environmental control with a combination of sensors, mechanisms and a software controlled sequence of operations. The control architecture allows precise mechanical movements of the through-feed motion of the workpiece and the in-feed motions of the two rolling dies in either the load control or position control mode of operation. Appropriate transducers and sensors are used to monitor each of these motions and loads, and are used to generate feedback signals, and thereby, the error signals used to drive the servo-controlled actuators for the in-feed and through-feed motions.

It was with knowledge of the foregoing state of the technology that the present invention has been conceived and is now reduced to practice.

SUMMARY OF THE INVENTION

In accordance with the present invention, a methodology is provided for spur and helical gears made of wrought or forged alloyed carbon steels, which utilizes the roll finishing tooling that performs net-shape full form roll finishing of gear teeth in a manner that simultaneously forms the active contacting surfaces of tooth flanks and the trochoidal root/fillet regions of the gear teeth. The essence of the invention is the technique for producing the roll finishing tooling capable of form finishing the entire contoured surface of the helical gear teeth in a single manufacturing operation.

A primary feature, then, of the present invention is the provision of a technique for precision form finishing of the entire contour of a machine element, typically the teeth of gears or sprockets, including the active contacting surfaces and the trochoidal root/fillet regions, thereby inducing material flow in the critical regions of the teeth.

Another feature of the present invention is the provision of such a technique of full form finishing by plastically deforming, thereby imparting material flow to the tooth surface layers of these regions which results in higher strength and accuracy of the teeth of the machine element.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
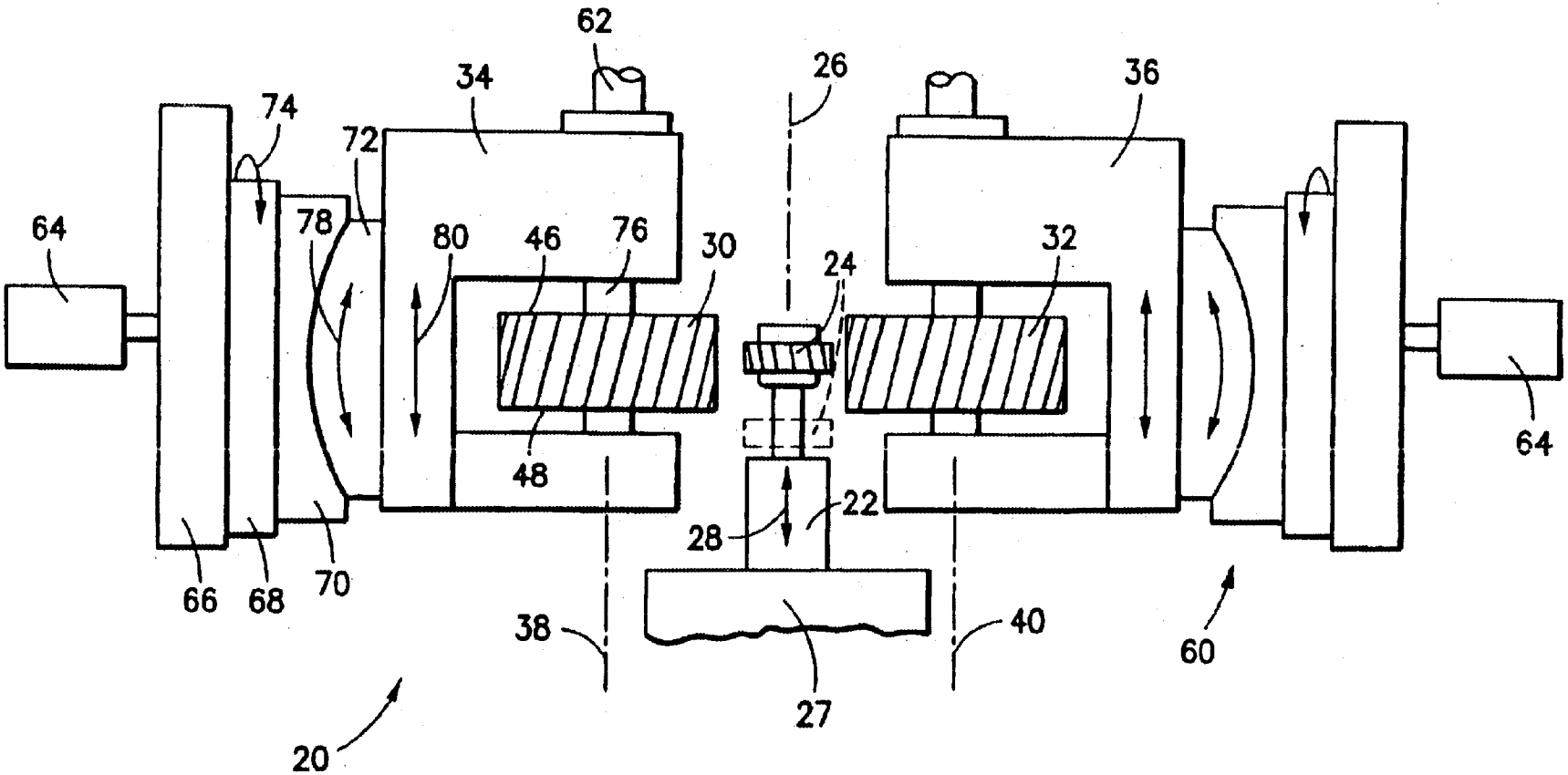
FIG. 1 PRIOR ART
FIG. 1 is a front elevation diagrammatic view diagrammatically illustrating known apparatus, which can utilize the techniques of the present invention, for performing precision gear finishing by controlled deformation.

Referring to FIG. 1, there is shown a diagrammatic front elevation view of a portion of apparatus 20 for performing precision gear finishing by controlled deformation and incorporating features of the present invention. Although the present invention will be described with reference to the embodiments shown in the drawings, it should be understood that the present invention can be embodied in many alternate forms of embodiments. In addition, any suitable size, shape or type of elements or materials consistent with the invention could be used.

The technique of the present invention may be integrated with or partially performed by equipment of the type disclosed in U.S. Pat. Nos. 5,221,513 and 5,451,275, both issued to Amateau et al. and referred to above. Indeed, the disclosures of these two patents is hereby incorporated, in their entirety, into this disclosure by reference.

The apparatus 20 employs a fixed axis spindle 22 which releasably supports a workpiece 24 for rotation about an axis 26 and is associated with a through-feed actuator 27 capable of moving the workpiece in through-feed directions indicated by a double-headed arrow 28 between a dashed line position and a solid line position. Additionally, a pair of rolling dies 30, 32 are supported on rolling die housings 34, 36, respectively, for rotation on generally parallel spaced axes 38, 40. When the workpiece 24 is in the solid line position, it is aligned or coextensive with the rolling dies.

Figure 2:
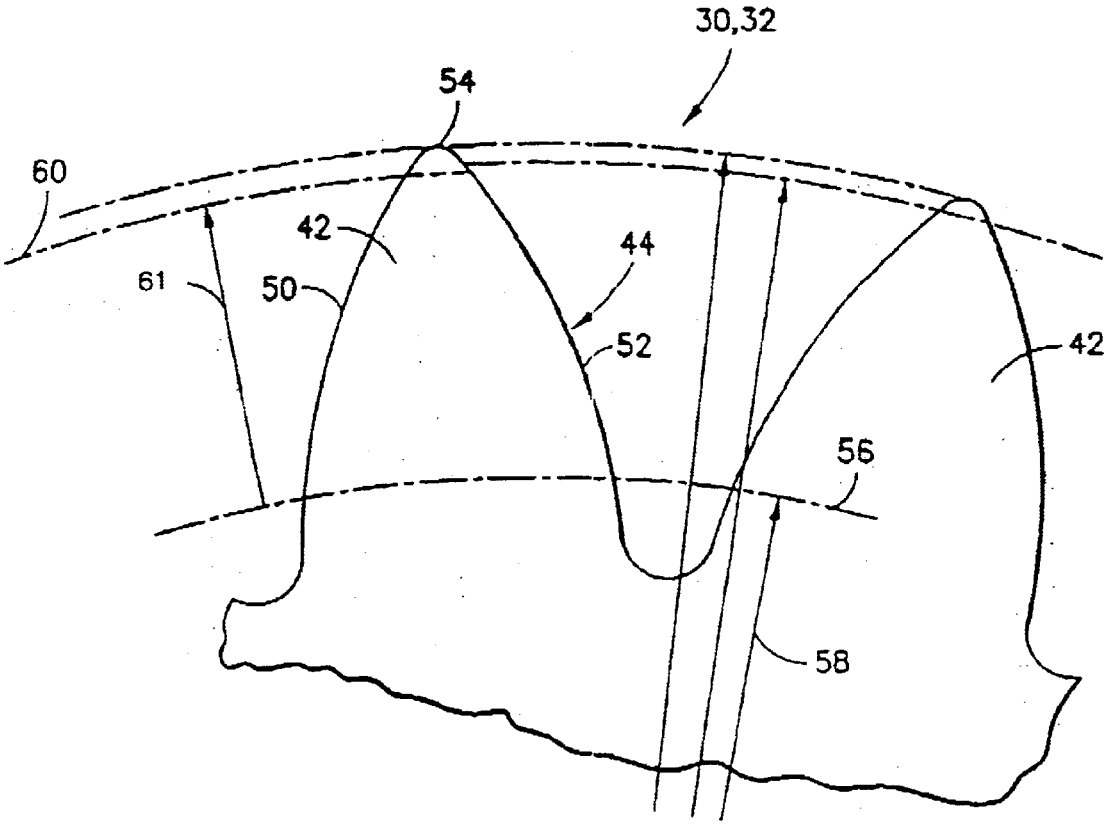
FIG. 2 is a diagrammatic elevation view of a part of a rolling die employed for purposes of the invention and designed to be conjugate to the required finished gear tooth profile.

Viewing FIG. 2, each rolling die has a plurality of teeth 42 and an outer peripheral contoured surface 44 extending between generally parallel spaced lateral surfaces 46, 48 transverse to the axes 38, 40. Each tooth 42 includes a tooth flank with opposed nominally involute surfaces 50, 52 and a tooth tip surface 54. While the surfaces 50, 52 are nominally, or essentially, involute surfaces, they may be slightly modified at their ends to improve performance. Continuing to view FIG. 2, the involute surfaces 50, 52 extend along the contoured surface 44 between an intersection with a circumferential line 56 having a radius 58 and a circumferential line 60 having a radius 61. The circumferential line 56 defines the innermost locus of points on the teeth 42 which will engage the teeth of the workpiece 24 during the finishing operation yet to be described and the circumferential line 60 defines the outermost locus of points on the teeth 42 which will engage the teeth of the workpiece 24 during the finishing operation.

For purposes of the present disclosure, the workpiece 24 is referred to initially as a "near net shaped gear blank" and when all processes of the invention have been completed, it is referred to as a "net shaped gear". As a near net shaped gear blank, it may have been hobbed or otherwise formed using conventional techniques. As such, for purposes of the invention, the workpiece 24 is formed with its gear teeth approximately 0.002 to 0.004 inches oversized in tooth thickness relative to the final or desired size so that the gear can meet the dimensional tolerances of AGMA required for high performance gears without the necessity of grinding. The displacement of the metal during the deforming operations performed in accordance with the invention serves to remove the excess tooth thickness while assuring the proper profile. Grinding is eliminated, and for this reason alone, there can be as much as a 70% increase in surface durability at any given contact stress level.

The housings 34, 36 for the rolling dies 30, 32 and adjustment mechanisms 60 to align the axes of the rolling dies in the in-plane, out-of-plane and axial direction (all to be subsequently described) are all contained in processing or quench media (not shown) to maintain the rolling hardware at a thermally stable forming temperature. The rolling dies 30, 32 are power driven through constant velocity joints 62 which allow in-feed motion of the rolling dies 30, 32 towards and away from the workpiece 24. The drive to at least one of the rolling dies is capable of phase adjustment so as to precisely align the rotational phase of one rolling gear die with respect to the other and thereby insure accurate engagement with the workpiece. The in-feed forces and motions are provided by the two in-feed actuators 64.

An in-feed assembly frame 66 is a first component to be operated by the actuator 64. A support block 68 is mounted on the in-feed assembly frame 66, then a helical adjustment plate 70 is mounted on the support block 68, then a parallel adjustment plate 72 is mounted on the plate 70. Finally, the bifurcated rolling gear die housing 34, 36 is mounted on the adjustment plate 72. The mounting construction between each successive pair of the components is different so as to provide for a different type of movement of the rolling dies 30, 32 with respect to the workpiece 24. More specifically, the helical adjustment plate 70 is movable relative to the assembly frame 66 (and support block 68) in a manner indicated by arcuate double arrowhead 74. Movement of this nature is effective to adjust the rolling gear dies 30 or 32 out of a common plane nominally defined by the axes of drive shafts 76 and of the through-feed spindle 22.

In a similar fashion, the parallel adjustment plate 72 is mounted on the helical adjustment plate 70 for relative motion as generally indicated by an arcuate double arrowhead 78. Adjustment of the rolling dies 30, 32 is thereby achieved within a common plane containing the longitudinal axes of the drive shafts 76 and of the through-feed spindle 24.

Finally, the rolling die housings 34, 36 are movable relative to the parallel adjustment plate 72 in directions represented by a double arrowhead 80, by reason of which the rolling dies 30, 32 are movable along their own axes of rotation relative to the workpiece 24.

Figure 3:
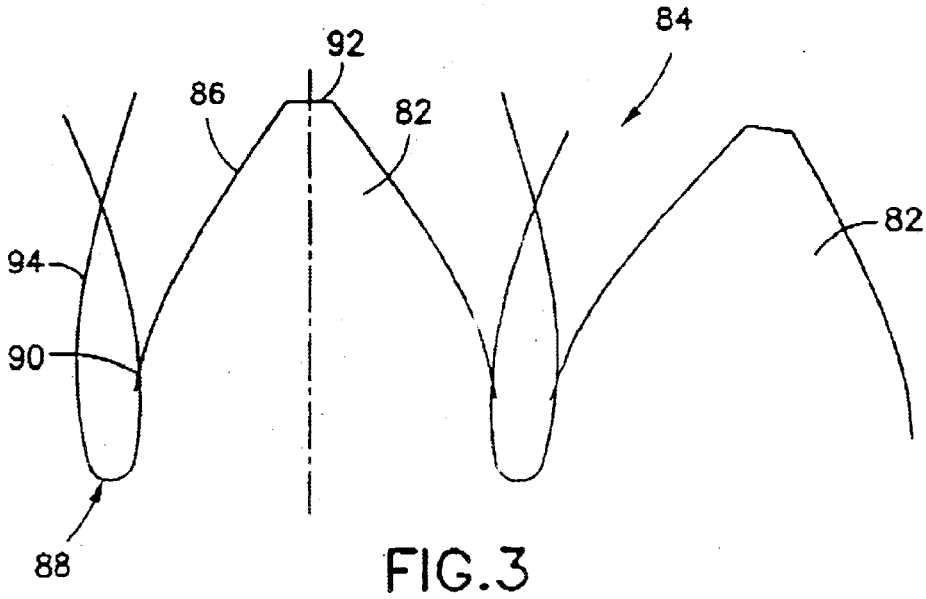
FIG. 3 is a diagrammatic elevation view of a part of a gear, made of wrought or forged alloyed carbon steels, being form finished according to the techniques of the invention and illustrating both the involute and trochoidal regions.
Figure 4:
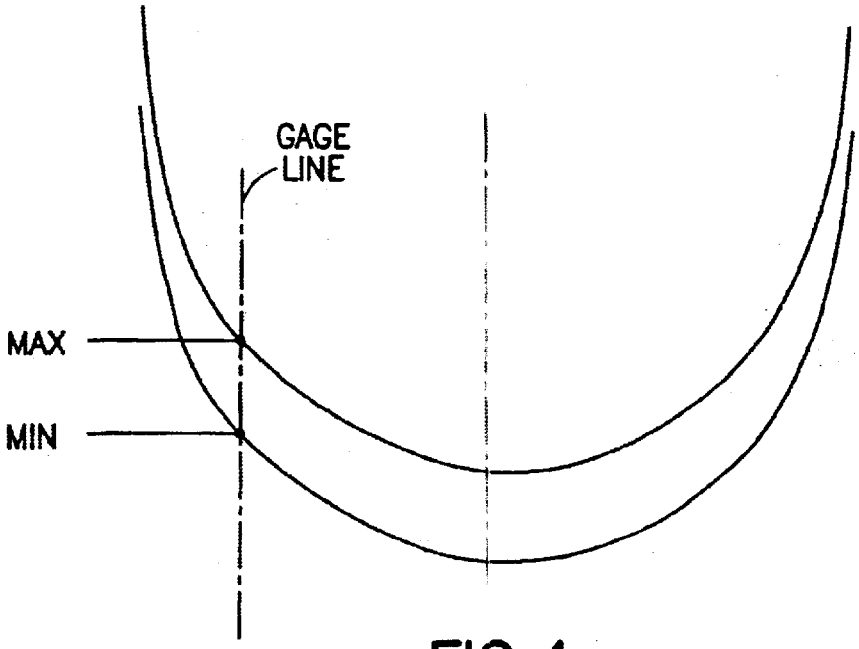
FIG. 4 is a diagrammatic elevation view illustrating the dimensional tolerance on the trochoidal contour of the root/fillet region of a gear formed in accordance with the invention.
Figure 5:
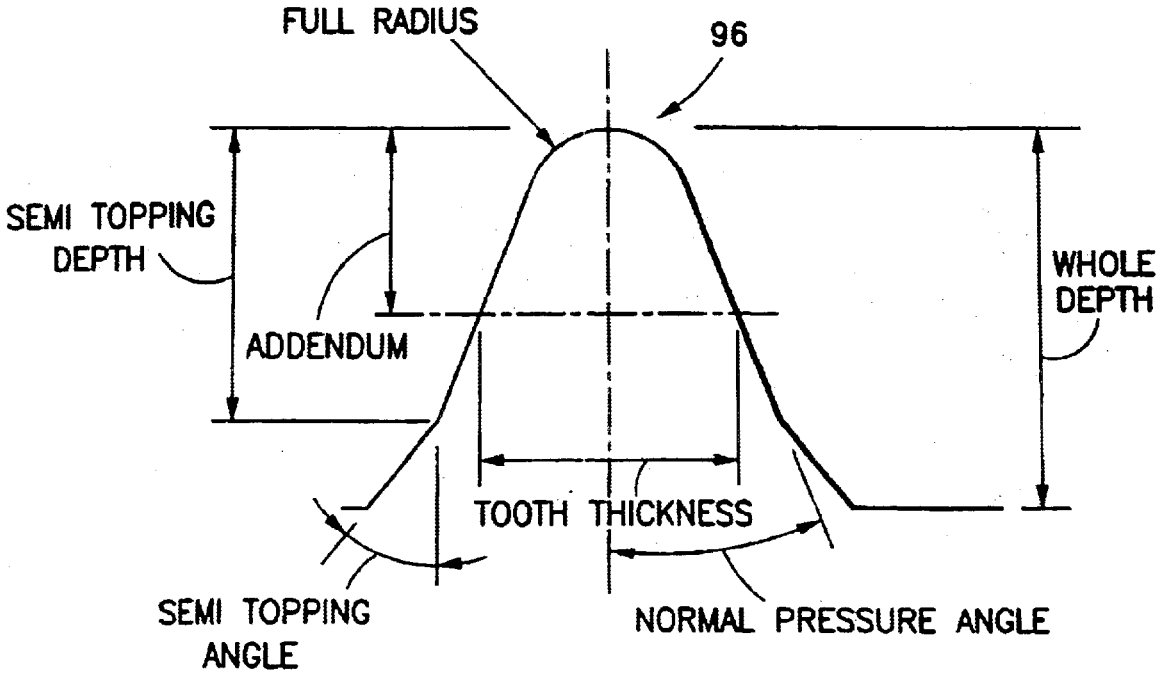
FIG. 5 is a diagrammatic elevation view illustrating the profile of a rack tooth form used to generate an as-hobbed gear workpiece, made of wrought or forged alloyed carbon steels.

Viewing FIG. 3, Involute gear tooth profiles are generated from rack tooth form. They comprise two distinct regions of gear teeth 82 of a typical gear 84, namely, the active contacting tooth flank surfaces 86 which have an involute tooth form, and the root/fillet region 88 which has a trochoidal tooth form. FIG. 3 illustrates these two regions and the point of tangency 90 between the regions. Gear designs specify the point of tangency 90, called the profile finish diameter, and the active contacting surface starts from this point and continues to near the outer diameter or tip 92 of the gear teeth. Below the profile finish diameter, that is, radially toward the center of the gear 84, the contour of the root/fillet region is prescribed in terms of the minimum fillet radius and the root diameter. The curve 94 is a trochoidal curve generated by the tip of the hobbing tool with the rack tooth form that is used to machine the gear teeth, and defines the root/fillet region 88. Further specifications for this region may also include dimensional tolerance on the trochoidal contour as shown in FIG. 4. An example of a rack tooth form used to design a gear hobbing tool 96 is shown in FIG. 5. Hobbing is one way of producing gear teeth by machining.

Figure 6:
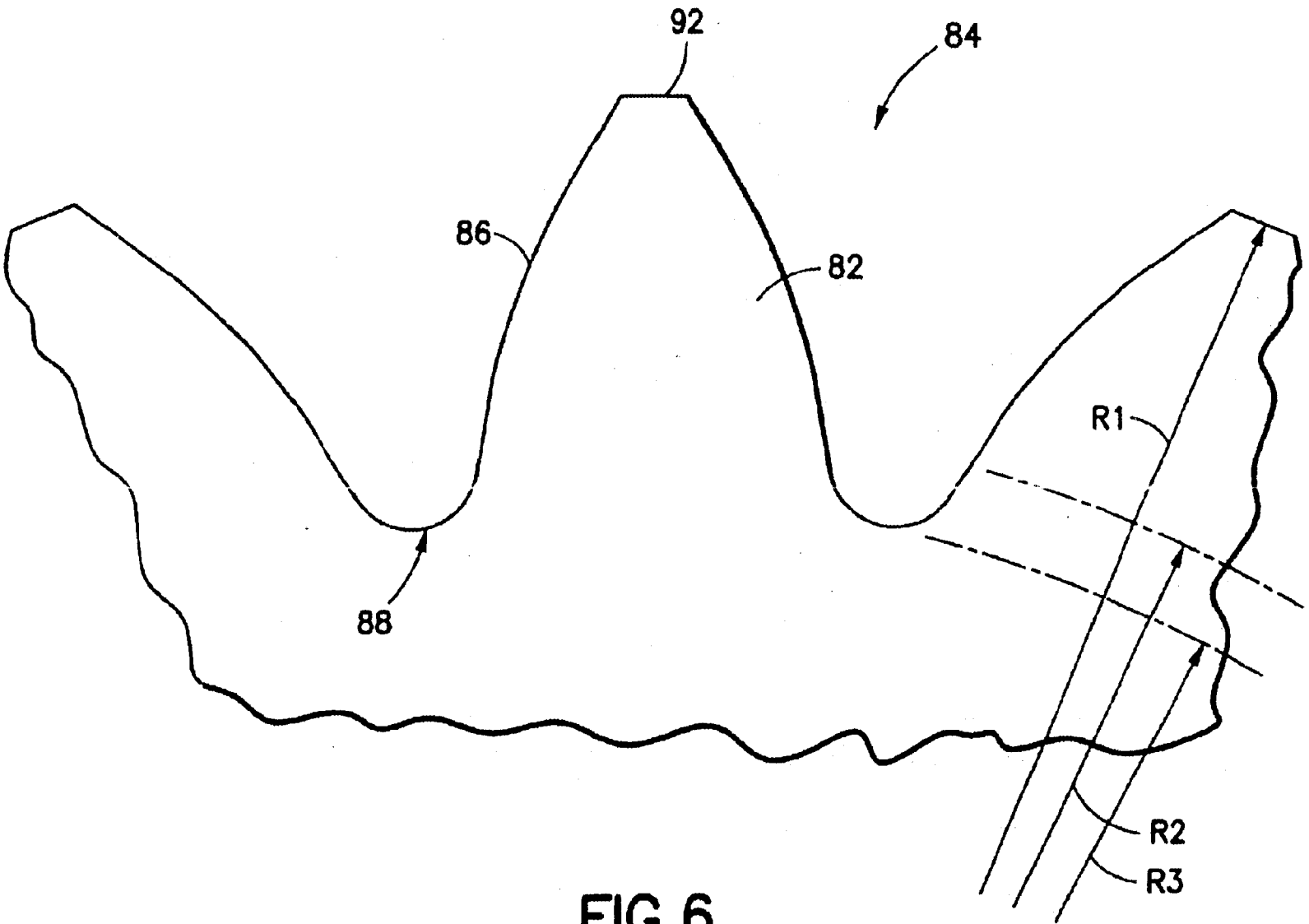
FIG. 6 is a diagrammatic elevation view, similar to FIG. 3, of a part of a gear being formed according to the techniques of the invention and illustrating both the involute and trochoidal regions.
Figure 7:
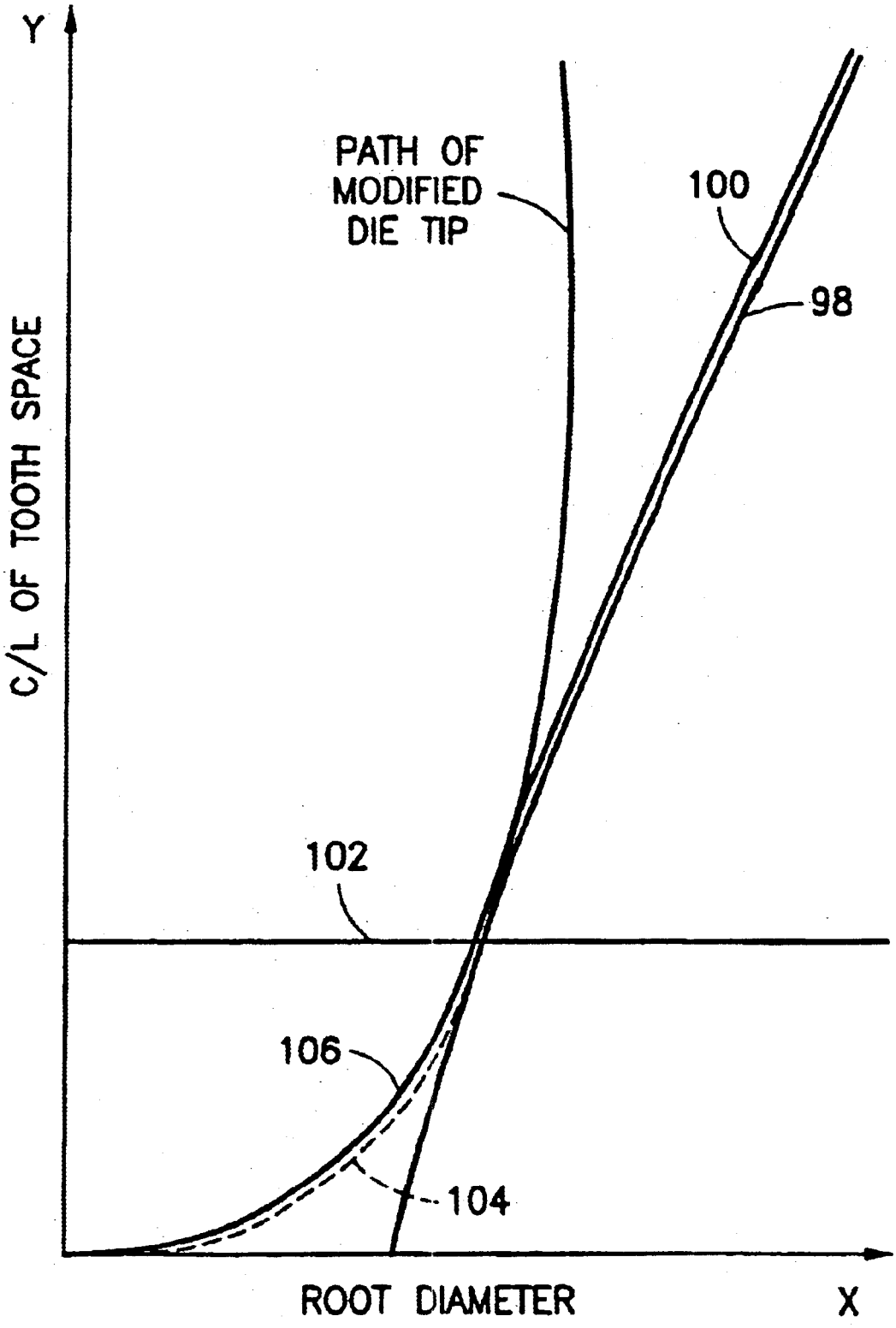
FIG. 7 is a diagrammatic illustration in a coordinate system of a typical roll finished gear tooth profile combined with the trace of the as-hobbed gear tooth profile with a rolling stock along the entire contour of the workpiece gear.

The design method to produce the desired rolling die tooth and tip profile proceeds from the definition of the required gear geometry and the definition of the basic rack form described above. Hence the transverse profile of gear teeth, which may be of the helical design or of the spur design, is first completely defined both in the area of active contact and in the area of the root/fillet, as shown for a typical gear 84 in FIG. 6. The as-hobbed gear tooth profile produced for subsequent full form roll finishing includes a smoothly varying non-uniform rolling stock along the entire contour of the gear teeth The technique of full form roll finishing is the essence of the current invention, and is diagrammatically illustrated in FIG. 7. FIG. 7 shows a typical roll finished gear tooth profile 98, as well as the trace of the as-hobbed gear tooth profile 100 with a rolling stock along the entire contour of the workpiece gear. For conventional roll finishing, the rolling stock would exist only above (that is, radially away from the center of the gear) the location defined by a line 102 referred to as the marked profile finish diameter. The die tooth tip surface 54 would be relieved so as not to interfere in the trochoidal region. However, the intention of the current invention is to plastically work the workpiece gear trochoidal or root/fillet region 88 in addition to the tooth flank surfaces 86. Therefore, an improved design of the rolling dies 30, 32 is disclosed with a modified tooth tip surface profile 54 that enables working of the root/fillet region. FIG. 7 also shows the trace 104, using dashed lines, of the rolling die tooth tip 54, and clearly shows the amount of material that would be plastically deformed along the entire contour of the gear teeth, the solid line trace 106 representing the root/fillet profile resulting from the hobbing operation. The tooth flanks or involute surfaces 50, 52 of the rolling die teeth 42 plastically deform and finish the active tooth flank contacting surfaces of the workpiece gear 24, whereas the tooth tip surface 54 of the rolling die teeth work the regions below the profile finish diameter 102, that is, the trochoidal root/fillet regions 88.

Figure 8:
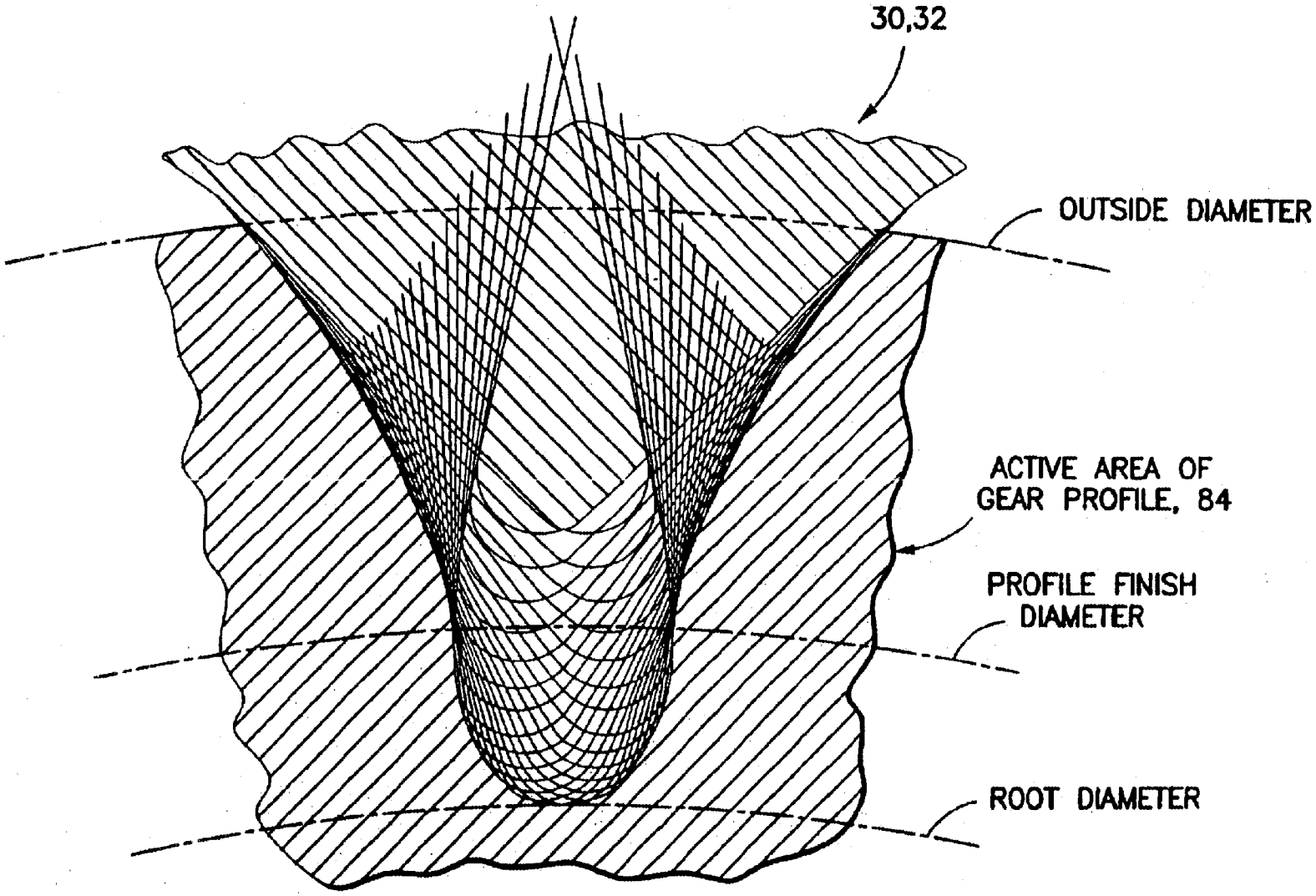
FIG. 8 is a diagrammatic detail cross section view illustrating the conjugate meshing of a rolling die and the workpiece gear, according to the techniques of the invention and depicting the roll finishing action in several incremental steps to produce the final desired tooth profile.

In order to effect material flow consistent with the stock to be moved along the entire gear tooth profile, it is necessary that a constant angular velocity be maintained between the roll finishing die and the workpiece gear 24 along the contacting path. Furthermore, in order to maintain a constant angular velocity, it is therefore necessary to produce on the rolling dies a tooth profile which is conjugate to the finished gear tooth profile during all phases of the engagement as shown in FIG. 7. A pair of mating gear tooth profiles are essentially cams, the driving tooth acting against the other to produce desired relative motion. One of the tooth profiles may be chosen at random, and the corresponding correct profile of the mate can be developed to produce uniform relative motion. The characteristics of the two mating gear tooth profiles are therefore interdependent, or conjugate, to ensure transmission of uniform rotary motion. FIG. 8 shows the conjugate meshing of one tooth of the rolling dies 30, 32 and the workpiece gear 84, and shows the roll finishing action in several incremental steps to produce the final desired tooth profile. The design method currently used by the industry utilizes rolling dies that are conjugate only up to the profile finish diameter, and therefore are capable of finishing only the active contacting surfaces. This invention is unique in that the die tooth profile maintains conjugacy in the root/fillet area of the gear tooth in addition to the area of active contact. FIG. 2, previously discussed, diagrammatically illustrates the profile of the rolling dies 30, 32, including the tooth tip surface used to deform the trochoidal root/fillet area and the remaining profile to finish the active contacting surfaces of the teeth 82 of the workpiece gear 84. The conjugate tooth profile of the die is determined based upon the meshing conditions and the complete transverse profile of the gear tooth that was described above.

Figure 9:
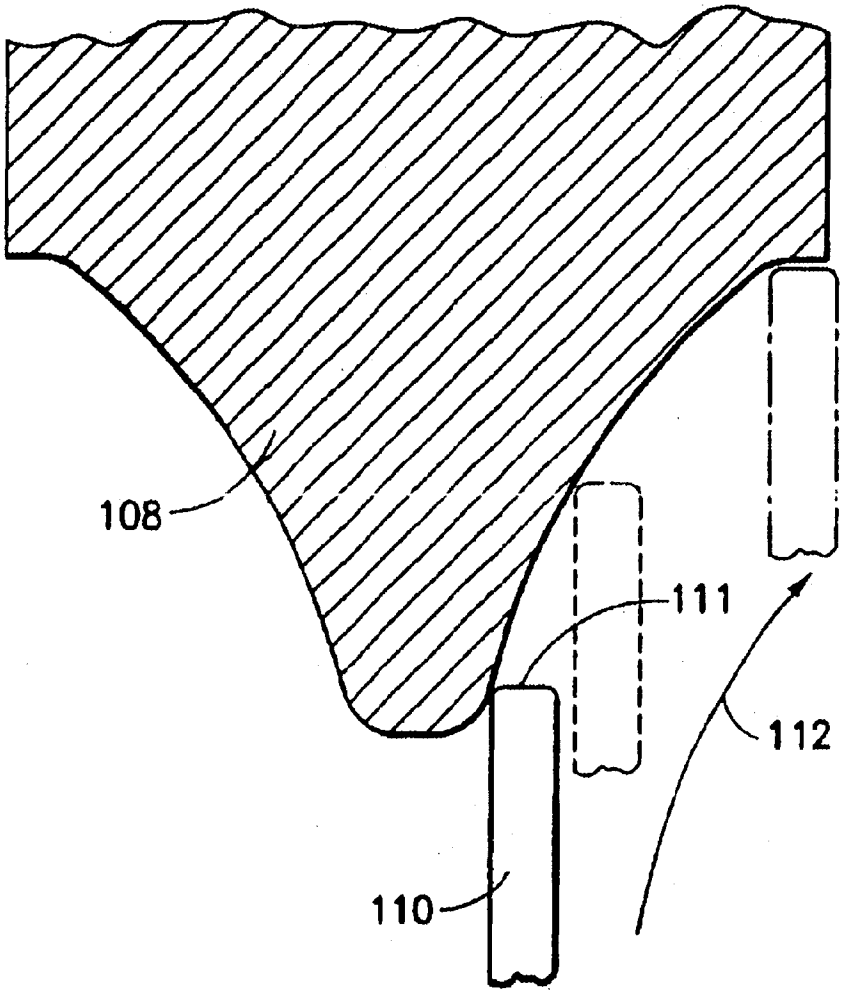
FIG. 9 is a diagrammatic detail cross section view illustrating the dressing of a grinding wheel to produce the designed conjugate rolling die tooth profile according to the invention.

The manufacturing method for producing the rolling die is by a precision form grinding technique. The rolling die tooth profile described above is dressed into a grinding wheel 108 by means of a disk-shaped diamond roll 110 having an outer peripheral surface 111 which engages the grinding wheel and follows a path indicated by an arrow 112, as shown in FIG. 9. The dressed grinding wheel 108 is then used to grind or produce the die tooth form. This technique is essentially similar to the technique for producing conventional rolling dies to finish only the active tooth surfaces. However, for the present invention, the diamond roll must precisely dress the profile of the die tooth tip surface 84. The required rolling die tooth profile coordinates determined from the design procedure described above are input to a CNC (computer numerically controlled) gear form grinding machine. This data is used for the dressing operation. The critical requirement here is the sharp radius of the diamond roll required for producing the profile in the grinding wheel. Typically, dressing diamond rolls exhibit a tip radius of 0.025"–0.050", which is adequate for conventional rolling dies. However, for full form rolling, a much smaller radius in the range of about 0.005" to about 0.012" is required to assure precise control of the generated die tooth profile shape as described in FIG. 7. Dressing the grinding wheel is the process used to shape the wheel to a specific profile, in order to generate the required rolling die tooth flank and tip profile. The grinding wheel produces the normal space between two adjacent teeth in form-grinding operations, and represents a rack for generating-grinding operations. For dressing, the grinding wheel is mounted on its wheel holder, balanced and then mounted on a machine spindle. Using a diamond tool, dressing is carried out by a combination of radial and axial motions of the diamond tool, while the grinding wheel is spinning at speeds close to or at grinding speed. Computer numerical control is used for the coordinated radial and axial motion of the dressing tool to precisely dress or shape the grinding wheel, so that the grinding wheel will in turn produce the desired shape on the rolling die teeth. Grinding wheel dressing is also used to remove any dulled abrasive grains and to expose the sharp next layer of the abrasive grains. The critical step is to control the dressing tool so that the calculated rolling die tooth profile and tip geometry is achieved.

Figure 10:
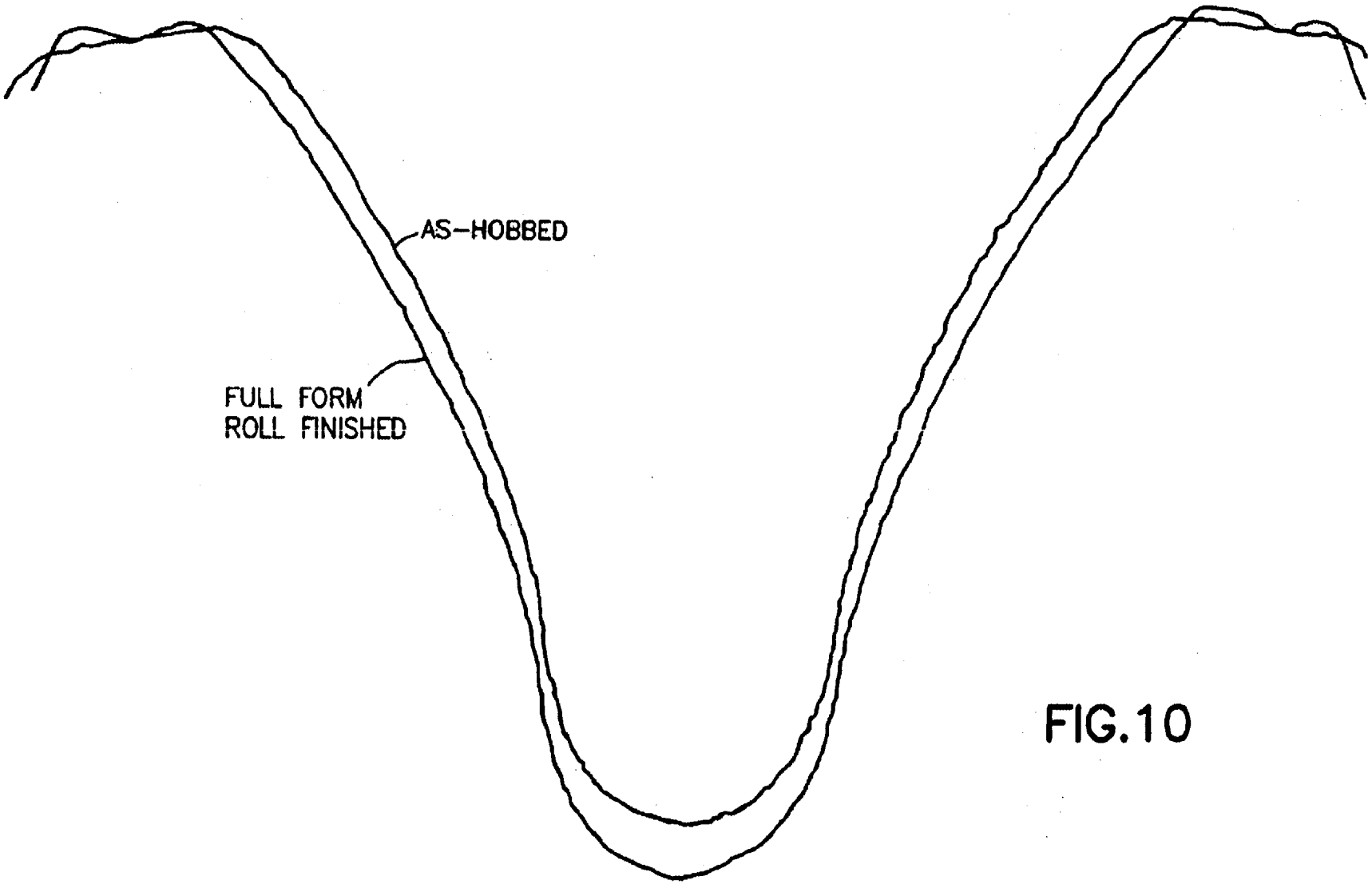
FIG. 10 is a diagrammatic illustration presenting a comparison of gear tooth profiles, specifically an as-hobbed profile and a full form roll finished profile according to the invention.

FIG. 10 compares the tooth profiles of workpiece gears in the as-hobbed and roll finished condition. The figure clearly demonstrates that a smoothly varying amount of material stock has been roll finished from the entire gear contour by means of full form roll finishing tooling developed as described and disclosed above.

A technique has now been disclosed for performing in one continuous operation full form roll finishing of critical regions of the teeth of contacting machine elements such as gears and sprockets, including the active contacting surfaces of the tooth flanks and the trochoidal root/fillet regions. The technique utilizes conjugate parallel-axis roll finishing dies with die tooth tip profile specially designed to trace the specified finished gear tooth profile. Machine elements that are to be full form roll finished are produced with a prescribed smoothly varying roll finishing stock along the entire tooth contour. The tooling development and processing technique are disclosed for plastically deforming the smoothly varying rolling stock along the entire gear tooth contour by conjugate meshing action.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A method of producing a full form net shape roll finished contacting machine element from a near net shape workpiece of wrought or forged steel having an initial outer peripheral contoured surface and including a plurality of teeth, each having a tooth flank with a nominally involute surface and a root/fillet region with a trochoidal surface, the method comprising the steps of:

rotatably supporting on a first axis a rolling die having an outer peripheral contoured surface extending between generally parallel spaced lateral surfaces transverse to the first axis, the rolling die including a plurality of teeth, each including a tooth flank with opposed involute surfaces and a tooth tip surface;

rotatably supporting the workpiece on a second axis distant from and parallel to the first axis;

advancing the rolling die in an in-feed direction generally perpendicular to the first and second axes such that the rolling die meshingly engages with the workpiece, rotating the rolling die about the first axis while engaged with the workpiece;

while performing step (d), maintaining continuous conjugacy between the rolling die and the workpiece with the involute surface of each tooth of the rolling die engaging the involute surface of a mating tooth of the workpiece and the tooth tip of the rolling die engaging the trochoidal root/fillet surface between adjacent mating teeth of the workpiece to effect material flow along the outer peripheral contoured surface;

continuing to advance the rolling die in the in-feed direction thereby deforming the surface of each tooth flank and of a corresponding root/fillet region until a final net shape of each tooth and root/fillet region is achieved, and continuing to perform all of the preceding steps with the rolling die and workpiece meshingly engaged, thereby deforming the involute and trochoidal root/fillet surfaces of all of the teeth of the workpiece resulting in a final net shaped machine element.

2. A method as set forth in claim 1 including the step, before step (c) of:

advancing the workpiece in a through-feed direction parallel to the first and second axes such that the outer peripheral contoured surface of the workpiece engages the outer peripheral contoured surface of the rolling die and continues to advance until the workpiece is positioned substantially coextensive with the rolling die in the through-feed direction.

3. A method as set forth in claim 2 wherein step (c) includes the steps of:

simultaneously with step (g) after the workpiece and rolling die are substantially enmeshed, advancing the rolling die within a plane containing the first and second axes, in an in-feed direction substantially perpendicular to the first and second axes until the outer peripheral contoured surface of the rolling die engages the outer peripheral contoured surface of the workpiece at a near net shaped center distance establishing an initial center distance between the first and second axes when the workpiece and the rolling gear die are initially engaged; and continuing to advance the workpiece in the in-feed direction by an additional increment of center distance thereby deforming the profile surfaces of each tooth resulting in final net shape of the teeth.

4. A method as set forth in claim 1 wherein the machine element being produced is a gear.

5. A method as set forth in claim 1 wherein the machine element being produced is a sprocket.

6. A method of producing a full form net shape roll finished contacting machine element from a near net shape workpiece of wrought or forged steel having an initial outer peripheral contoured surface and including a plurality of teeth, each having a tooth flank with a nominally involute surface and a root/fillet region with a trochoidal surface, the method comprising the steps of:

rotatably supporting on first and second generally parallel spaced axes, first and second rolling dies, each having an outer peripheral contoured surface extending between generally parallel spaced lateral surfaces transverse to the first axis, each rolling die including a plurality of teeth, each tooth including a tooth flank with opposed involute surf aces and a tooth tip surface;

rotatably supporting the workpiece on a third axis distant from and parallel to the first and second axes;

advancing the first and second rolling dies, within a common plane generally containing the first, second, and third axes in respectively opposite in-feed directions generally perpendicular to the third axis until the rolling die meshingly engages with the workpiece, rotating the rolling dies at a constant angular velocity about their associated first and second axes while engaged with the workpiece;

while performing step (d), maintaining continuous conjugacy between each of the rolling dies and the workpiece with the involute surface of each tooth of each of the rolling dies engaging the involute surface of a mating tooth of the workpiece and the tooth tip of each of the rolling dies engaging the trochoidal root/fillet surface between adjacent mating teeth of the workpiece to effect material flow along the outer peripheral contoured surface;

continuing to advance each of the rolling dies in the in-feed direction thereby deforming the surface of each tooth flank and of a corresponding root/fillet region until a final net shape of each tooth and of each root/fillet region is achieved, and continuing to perform all of the preceding steps with the rolling dies and workpiece meshingly engaged, thereby deforming the involute and trochoidal root/fillet surfaces of all of the teeth of the workpiece resulting in a final net shaped machine element.

7. A method as set forth in claim 6 including the step, before step (c) of:

advancing the workpiece in a through-feed direction parallel to the first, second, and third axes such that the outer peripheral contoured surface of the workpiece engages the outer peripheral contoured surface of each of the rolling dies and continues to advance until the workpiece is positioned substantially coextensive with the rolling dies in the through-feed direction.

8. A method as set forth in claim 7 wherein step (c) includes the steps of:

simultaneously with step (g) after the workpiece and rolling die are substantially enmeshed, advancing the rolling die within a plane containing the first and second axes, in an in-feed direction substantially perpendicular to the first and second axes, until the outer peripheral contoured surface of the rolling die engages the outer peripheral contoured surface of the workpiece at a near net shaped center distance establishing an initial center distance between the first and second axes when the workpiece and the rolling gear die are initially engaged; and continuing to advance the workpiece in the in-feed direction by an additional increment of center distance thereby deforming the profile surfaces of each tooth resulting in final net shape of the teeth.

9. A method as set forth in claim 6 wherein the machine element being produced is a gear.

10. A method as set forth in claim 6 wherein the machine element being produced is a sprocket.

* * * * *